United States Patent [19]

Dumesnil et al.

[11] Patent Number: 4,839,568

[45] Date of Patent: Jun. 13, 1989

[54] MAGNETIC DEFLECTOR FOR TRICHROMATIC TUBE WITH SHIELD AND METHOD TO SET THIS DEFLECTOR

[75] Inventors: Alain Dumesnil, Genlis; Jean-Marc Perreaut, Dijon, both of France

[73] Assignee: Videocolor, Montrouge, France

[21] Appl. No.: 101,787

[22] Filed: Sep. 28, 1987

[30] Foreign Application Priority Data

Jul. 17, 1987 [FR] France ..... 87 10123

[51] Int. Cl.[4] ..... H01J 29/70; H01J 29/76

[52] U.S. Cl. ..... 315/368; 315/370; 315/371; 335/214; 313/428

[58] Field of Search ..... 315/368, 370, 371; 313/428, 440, 431; 335/212, 213, 214

[56] References Cited

U.S. PATENT DOCUMENTS 3,912,970 10/1975 Chandler et al. ..... 335/213
4,257,024 3/1981 Shimoma et al. ..... 335/213
4,524,308 6/1985 Suzuki ..... 315/368
4,700,164 10/1987 Roussel ..... 335/213

*Primary Examiner*—Theodore M. Blum
*Attorney, Agent, or Firm*—Oblon, Fisher, Spivak, McClelland & Maier

[57] ABSTRACT

A magnetic deflector of the saddle-saddle type, for a trichromatic tube protected by a shield, with in-line guns and round-luminophor type screen, is designed to function with a saddle-torus type of magnetic deflector. The invention uses a saddle-saddle type of deflector in which the front leading-out wires have been reduced and the rear leading-out wires are laid flat. Furthermore, the ferrite piece is extended by a ring which surrounds the rear leading-out wires and is magnetically closed by a ferrite ring bearing a quadrupole coil powered by a parabolic current. The intention can be applied to round-luminiphor trichromatic tubes fitted with an external shield.

8 Claims, 3 Drawing Sheets

MAGNETIC DEFLECTOR FOR TRICHROMATIC TUBE WITH SHIELD AND METHOD TO SET THIS DEFLECTOR

BACKGROUND OF THE INVENTION

1. Field of the Invention

The invention pertains to a magnetic deflector for a trichromatic tube protected by a shield, with in-line guns and a round-luminophor type screen, and to a method for setting a deflector of this type.

2. Description of the Prior Art

A trichromatic or color television tube is a cathode-ray tube with three parts: a relatively flat front side or screen, a cylindrical rear part or neck and a central flared part connecting the screen to the neck. On the screen, each color pixel has three juxtaposed primary luminophor elements of red, green and blue, which are small enough (dimensions of less than 1 millimeter) for the eye not to separate them and for it to receive receive the sum of the three primary light fluxes as a whole. Color is thus achieved by additive synthesis. The neck, which forms the extension of the flared central part, supports three electron guns that project their electronic beams on the screen of the tube so as to excite each luminophor of a particular color. The action of the electron beams is made selective by a perforated mask, placed near the screen: each hole of this mask cuts out a calibrated cylinder of electrons from the beams. The relative angle of convergence of the three beams ensures that the three cylinders are separated, and the depositing of the round luminophors on the screen is such that beam can fall only on those luminophors for which it is intended.

To create a color image on the screen, the entire surface of the screen has to be illuminated by all three beams and, for this purpose, the screen is scanned in successive lines of luminophors using a magnetic deflector. This magnetic deflector comprises coils through which there flow currents of an intensity that may vary according to the angular deflection of the beam to be obtained. One of the coils of the deflector is used to displace the beams horizontally: this is known as line scanning. The other coil is used to displace the beams vertically: this is frame scanning. In conventional color television tubes, the scanning frequencies are 15,625 hertz for the lines and 50 hertz for the frames.

To deposit luminophors when manufacturing the tube, the screen is illuminated by one and the same light source, through the mask, at different angles of incidence which correspond to the selective convergence angles of the three electronic beams so as to define the position of the luminophors on the screen. These three different illuminations of the screen are obtained by an optic lens which gives a precise reproduction, on the light beams, of the deflections which will be obtained by the magnetic deflector on each of the electron beams projected by the electron guns. This shows that the type of magnetic deflector which will be used affects the manufacture of the tube through the optic lens, and this means that a tube manufactured for a certain type of deflector does not work properly if it is mounted with a deflector of another type.

The quality of a trichromatic tube can be defined by three parameters. These are firstly its purity, namely the selectivity of the electron beams with regard to the luminophors, secondly its convergence, namely the convergence of the three beams at one and the same point, and thirdly its sensitivity which is measured as being the energy needed to scan a horizontal or vertical axis of the tube.

It can be seen that if an electronic beam corresponding to a particular color, red for example, excites all or a part of a luminophor of another color, blue for example, the result will be a color that does not correspond to the color sought, and it will be then said that the tube does not have a good degree of purity. A purity defect of this type can be measured by the position of a point, known as the centre of purity, which is the virtual point from where the beam appears to come according to the laws of geometrical optics. Thus when the beam is centered on the luminophor, it seems to come from a center of ideal purity. This center of purity is shifted when the beam is not centered on the luminophor and this shift can take place in three orthogonal directions, namely the horizontal (line) and vertical (frame) directions and the axis of the tube.

As regards convergence, it must first of all be noted that the three electron beams come from three electron guns which are set side by side in a horizontal plane (hence the term "in-line guns") and are separated from one another by a distance of several millimeters. Owing to this arrangement of the electron guns, the corresponding electron beams do not tend to converge on one and the same pixel of the screen in which the distances between the centers of the luminophors are smaller than 1 millimeter. The deflector is provided to correct this defect which is measured by a three-parameter function known as the trilemma T, such that:

$$T = C\,3/9 + Trh - C\,6/12,$$

where:

C 3/9 is the "3:00 o'clock/9:00 o'clock" (6H/9H) convergence between red and blue.

C 6/12 is the "6:00 o'clock/9:00 o'clock" (6H/12H) convergence between red and blue.

Trh is the horizontal red/blue trapezoid.

Of course, it is sought to obtain T=0, which corresponds to a perfect convergence of the "red" and "blue" beams which are the extreme beams on either side of the central "green" beam.

The above explanations help in understanding the fact that the trichromatic tube is sensitive to modifications of the magnetic field because these modifications affect its purity and convergence characteristics. Consequently, for special applications such as equipment on aircraft or ships, the trichromatic tube should be shielded against unwanted radiation and against the earth's magnetic field by suitable shielding. A shieldig of this type, set around the tube and the magnetic deflector, profoundly modifies the purity, convergence and sensitivity characteristics of the tube because it has an effect on the geometry of the force lines of the magnetic fields created by the deflector coils. The modifications differ according to the type of deflector used.

For a magnetic deflector of the saddle-torus type, in which the saddle-shaped coil is used for line scanning, and the toroid-shaped coil arranged around the line coil is used for frame scanning, the shield has two effects on purity: firstly, it shifts the center of purity towards the rear of the tube along the axis and, secondly, it modifies the position of the line and frame centers of purity. This modification gives an unacceptable level of purity in the tube. The modification of the position of the line and frame centers of purity, i.e. the modification of their coincidence, is due chiefly to the fact that the shield short-circuits the force lines of the magnetic field external to the toroid-shaped frame coil.

The shield also modifies the convergence of the electron beams by increasing the trilemma T which may reach 0.8 millimeters. More precisely, the convergence C 3/9 remains unchanged but the convergence C 6/12 changes from 0 to 0.5 millimeters while the horizontal trapezoid Trh changes from 0 to −0.3 millimeters.

The fact that the shield short-circuits the force lines of the magnetic field also means that a part of the electrical energy applied to the line and frame coils is not used for the scanning. A result of this, there is a loss in sensitivity. Losses of 7% have been measured for line scanning and of 38% for frame scanning.

For a saddle-saddle type of magnetic deflector, in which both coils (line and frame) are saddle-shaped, with the frame coil surrounding the line coil, the effects of the shield on the characteristics of the trichromatic tube are smaller than those encountered in a saddle-torus deflector. Thus, the corvergence measured by the trilemma T can be adjusted along the entire surface of the screen at a value compatible with the requisite quality while the sensitivity is not modified. By contrast, it has been observed that the shield affects the purity along the vertical axis 6H/12H, especially in the corners of the screen where the error reaches half a luminophor.

The above comparison between these two types of magnetic deflector in the presence of a shield shows that a saddle-saddle type of deflector is more appropriate for use with a shield. However, it must be noted that there are special problems to be resolved in high-definition trichromatic tubes which have line scanning at a high frequency of about 64 kilohertz. For the pitch of the mask holes is at least twice or three times smaller than the pitch for holes in masks of conventional trichromatic tubes, entailing severer requirements in terms of purity and convergence.

Another problem to be resolved pertains to the correction of the so-called coma error, which is due to the fact that the electron beams are not subjected to the same magnetic field in the deflector and are therefore deflected differently. In conventional trichromatic tubes this error is corrected, before entry into the deflector, by means of magnetic parts set on either side of the red and blue beams: the purpose of these magnetic parts is to short-circuit the force lines of the magnetic field and, hence, to modify the magnetic field and the path of the beam. These magnetic parts cannot be used for a high scanning frequency because they get heated, a fact that modifies their effect on the beams.

SUMMARY OF THE INVENTION

An object of the present invention is therefore to make a magnetic deflector of the saddle-saddle type for trichromatic tubes with external shielding, with three in-line guns and a round luminophor high-definition screen, whereas the tube is normally designed for operation with a saddle-torus type of deflector.

Another object of the present invention, therefore, is to make a magnetic deflector comprising an arrangement of sections of coils by which the coma error can be corrected.

Yet another object of the present invention is to make a magnetic deflector comprising a mechanism to adjust the coincidence of the orthogonal angles of the tube and the deflector, a mechanism which is easy to use.

The invention pertains to a magnetic deflector of the saddle-saddle type for trichromatic tubes with external shielding, with three in-line guns and a round-luminophor, high-definition screen, the said tube being planned for operation with a saddle-torus type of deflector, the said saddle-saddle type of magnetic deflector comprising:

A horizontal deviation coil of the saddle type surrounding the tube at the flared part of the tube near the neck, the said coil having front leading-out wires of reduced dimensions as well as rear, leading-out wires which are laid flat;

A vertical deviation coil of the saddle type surrounding the horizontal deviation coil and having front leading-out wires of reduced dimensions as well as rear, leading-out wires laid flat;

A flare-shaped sleeve made of ferromagnetic material surrounding the vertical deflection coil, the said flare-shaped sleeve ending towards the rear in a circular-sectioned cylinder which entirely covers the rear leading-out wires;

A ferrite ring set around the neck in the immediate vicinity of the rear part of the sleeve and the horizontal and vertical deflection coils, the said ring bearing at least one quadrupole coil, and Means to cause a current, the intensity of which varies parabolically, to flow in the quadrupole coil of the ferrite ring.

To correct the coma error, the sections of the horizontal and vertical deflection coils are arranged with respect to one another in such a way as to modulate the magnetic field created at the rear leading-out wires.

The sections of the coils are set in notches made on the internal surface of two flare-shaped sleeves, made of non-magnetic material, which nest into each other.

To obtain the current which varies parabolically, a part of the current flowing through the frame coil is applied to an integrator circuit which has its output signal applied to the quadrupole coil by means of an amplifier circuit.

For the easier installation and setting of the deflector, it is made in two parts, the positions of which can be adjusted with respect to each other: thus the ferrite ring is sealing-filled to be fixed to the neck of the tube and is hinged with the rest of the deflector by means of four setting screws. To make this hinge, the rear of the deflector has a spherical shape so that it can lie on a circular shoulder of the ferrite ring sealing.

The method of the invention for setting the deflector comprises the following operations:

Positioning the deflector on the flared part of the tube so that the center of purity of the tube is made to coincide with the center of purity of the deflector;

Shifting all the coils and the ferromagnetic sleeve with respect to the ferrite ring so as to make the horizontal and vertical axes of the tube coincide with the corresponding electromagnetic axes of the deflector, and Setting the value of the current flowing through the quadrupole coil of the ferrite ring so as to cancel the convergence error 6H/12H, with the convergence error 3H/9H and the horizontal trapezoid error being cancelled through a special construction of the coils which modifies the component of the first even harmonic H2 of the magnetic field created by the said coils.

BRIEF DESCRIPTION OF THE DRAWINGS

Other characteristics and advantages of the present invention will emerge from the following description of a special embodiment, the description being made with reference to the appended drawings, of which.

Figure 4:
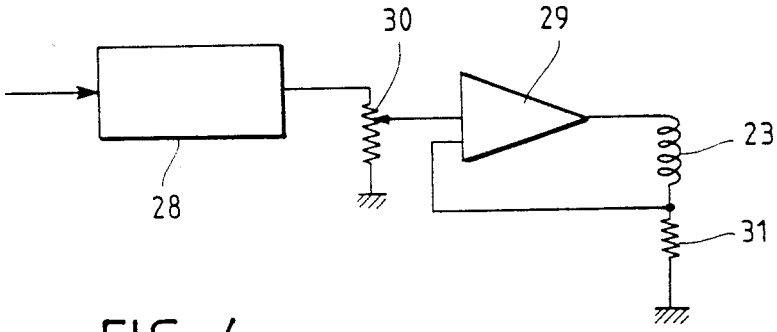

FIG. *3a* is a graph showing the shape of he current flowing in the frame coil;

FIG. *3b* is a graph showing the shape of the current flowing in the quadrupole coil set at the end ring to obtain the convergence correction along the vertical axis 6H/12H;

FIG. 4 is a simplified diagram of a circuit used to obtain the current having the graph pattern shown in FIG. *3b;*

Figure 6:
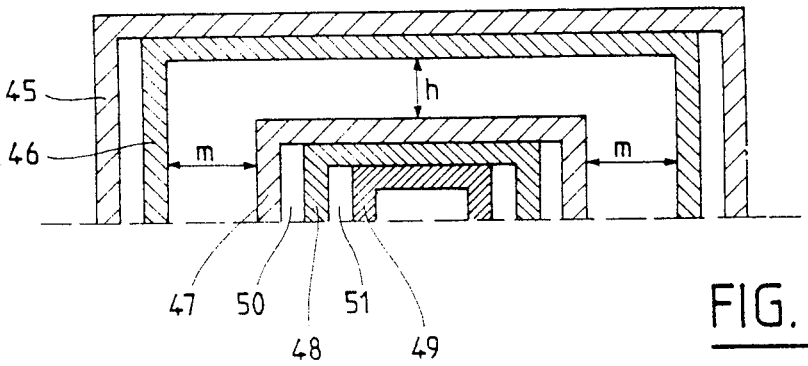
Figure 5:
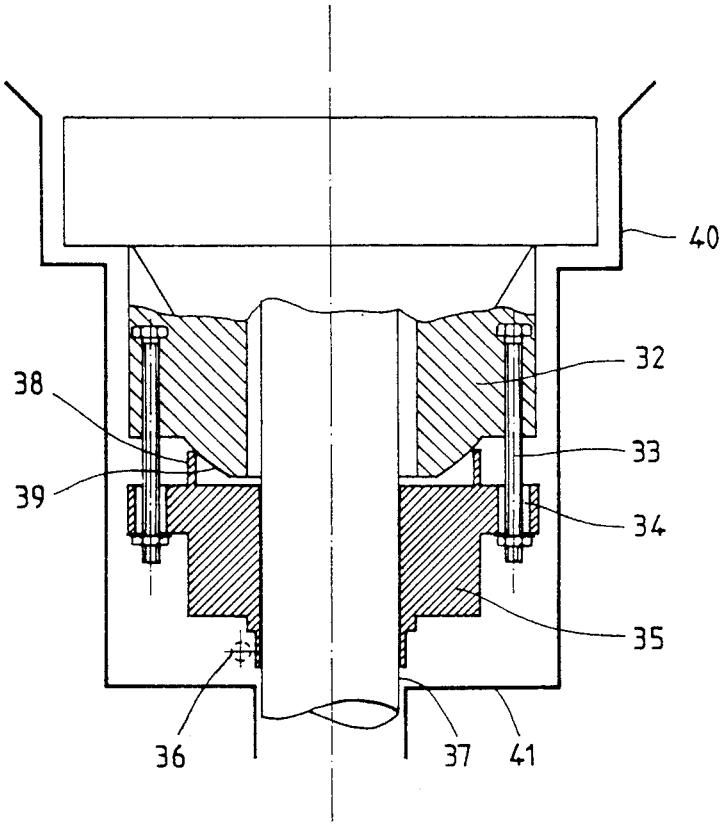

FIG. 5 is a schematic, longitudinal cross-section view of the lay-out between the line and frame coils and the ring bearing the quadrupole coil in such a way as to enable the setting of the position of the magnetic deflector, and FIG. 6 shows a possible arrangement of the line and frame coil windings to correct the coma error.

DESCRIPTION OF THE PREFERRED EMBODIMENT

Figure 1:
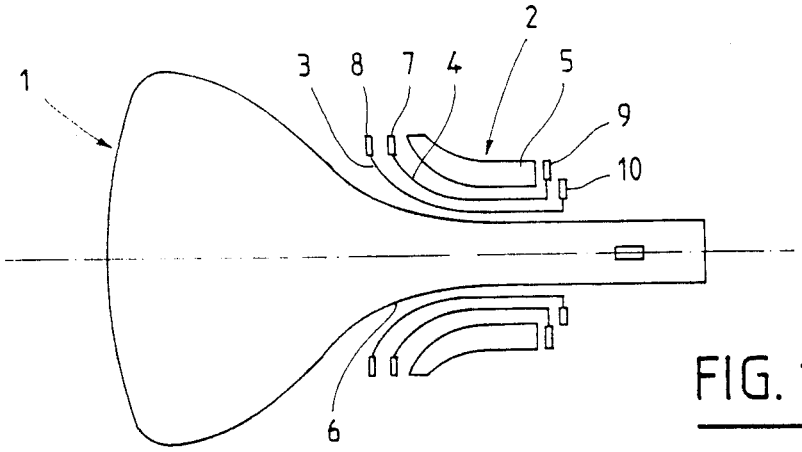
FIG. 1 is a schematic, longitudinal cross-section view of a trichromatic tube fitted with a saddle-saddle type of magnetic deflector according to the invention.

In FIG. 1, a trichromatic tube 1 is fitted with a saddle-saddle type of magnetic deflector 2 according to the prior art, comprising a first, horizontal deflection coil 3, called a line coil, and a second vertical deflection coil 4, called a frame coil, both saddle-shaped, and a magnetic circuit 5 made of a ferromagnetic material. The line coil 3 is placed near the wall 6 of the tube 1 while the frame coil 4 is placed near the magnetic circuit 5. The magnetic circuit has the shape of a sleeve open at both ends so that the windings of the line and frame coils can be placed radially towards the outside of the tube and can form leading-out wires marked 7 and 8 for those set in the front of the tube and marked 9 and 10 for those set in the rear side of the tube.

Figure 2:
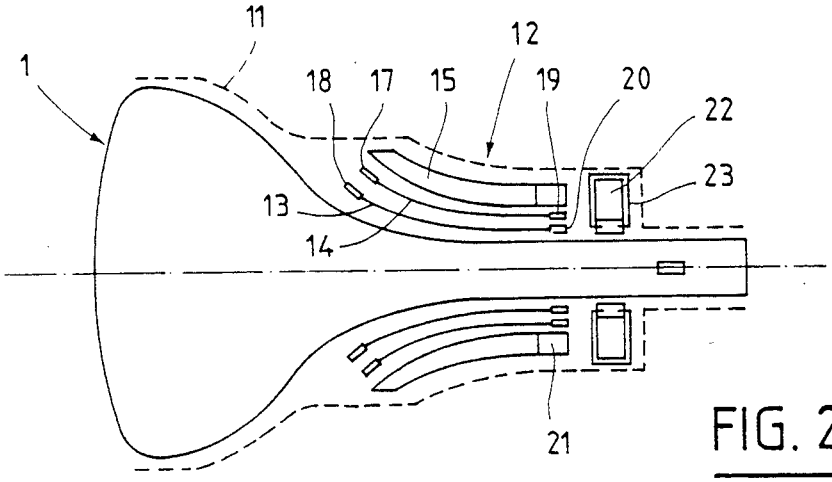
FIG. 2 is a schematic, longitudinal cross-section view of a trichromatic tube fitted with a saddle-saddle type of magnetic deflector according to the invention.

When the tube 1 and the magnetic deflector 2 are surrounded by a shield 11 (FIG. 2), it is proposed to modify the magnetic deflector as shown in FIG. 2.

This deflector 12 has a line coil 13 set near the glass 6 of the tube 1, a frame coil 14 surrounding the line coil 13, both saddle-shaped, and a magnetic circuit 15 near the frame coil 14 surrounding the said frame coil 14. The rear leading-out wires 19, 20 of the line and frame coils extend longitudinally and no longer radially and are entirely surrounded by the magnetic circuit 15. For this purpose, the magnetic circuit 15, for example, is extended towards the rear by a ferrite ring 21. The front leading-out wires 17 and 18 have reduced dimensions and extend beyond the ferrite.

The magnetic circuit 15 is closed towards the rear by a ferrite ring 22 which notably bears a quadrupole coil 23. This ring 22 is set around the neck of the tube near the rear leading-out wires 19 and 20 and the ferrite ring 21.

The windings of the quadrupole coil 23 are set within notches cut out along the inner rim of the ring 22. This quadrupole coil is powered by a current which varies parabolically in synchronization with the linearly varying current that flows in the frame coil. More precisely, it is known that, to obtain a linear vertical deflection of the electron beams, the frame coil 14 must be powered by a current which varies linearly as a function of time along the central curve 24 of the FIG. *3a,* the lateral curves 25 corresponding to the frame return currents. To obtain a current which varies parabolically along the central curve 26 of FIG. *3b,* a part of the frame current is applied to a multiplier circuit 28 (FIG. 4) which integrates the signal applied to it. The output signal of this multiplier circuit 28 is applied to the quadrupole coil 23 by means of an operational amplifier 29. A potentiometer 30 is used to vary the amplitude of the parabolic signal and thus to do the setting.

Figure 3A:
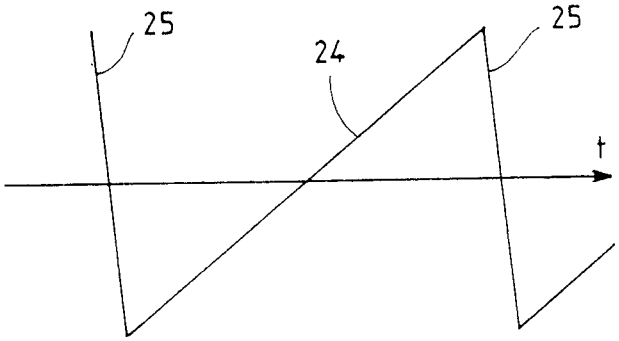
Figure 3B:
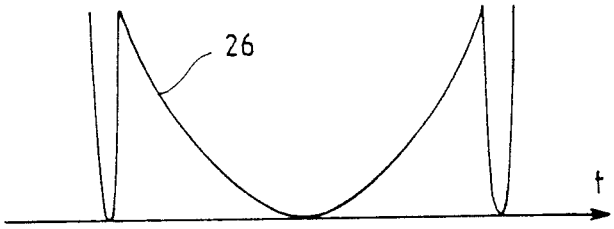

The various elements of the magnetic deflector which have just been described schematically with reference to FIGS. 2, 3 and 4, can be made in different ways which are within the scope of the specialist. Thus the line coil 13 and the frame coil 14 can each be borne by a flare-shaped sleeve made of plastic material with notches on the inner surface to accomodate the windings of each coil, thus giving a precise arrangement of the said windings and, hence, a precise and constant distribution of the magnetic fields. These two sleeves are fitted into each other and the external sleeve which bears the frame coil may also constitute both the magnetic circuit 15 and the ferrite ring 21 which extends the said magnetic circuit 15.

The ferrite ring 22 which closes the rear end of the coils 13, 14 of the magnetic circuit 15, ending in the ring 21, can be separated from the other elements which have just been referred to, but can be combined with them according to the assembly which shall now be decribed with reference to FIG. 5.

In this FIG. 5, which is a longitudinal cross-section of the rear part of the magnetic deflector, the said deflector ends in a spherical-shaped sealing 32. Four screws, such as those marked 33, are incorporated in the sealing 32 and work in cooperation with four holes, such as those marked 34, which are drilled into a sealing 35 surrounding the ferrite ring 22 and the coils that it bears. The holes 34 have a diameter greater than that of the screws 33 so as to give clearance to the said screws. In the rear, the sealing 35 is joined to a collar 36 used to fix the sealing 35 to the glass 37 of the tube neck. That side of the sealing 35 which faces the spherical part of the rear sealing of the magnetic deflector has a ring-shaped shoulder 38 on which the spherical surface 39 lies, in such a way as to enable the deflector to be shifted with respect to the sealing 35 under the action of the screws 33 and their associated nuts.

The element marked 40 designates the shield of the tube and the associated deflector. The shield is closed towards the rear by a plate 41 which should then have holes facing the screws 33 so that the associated nuts can be screwed in.

Of course, the lay-out of the spherical rear part of the deflector with the circular shoulder 38 of the sealing-filled 35 can be achieved with deflectors other than those showing the characteristics of the present invention.

The magnetic deflector described above has line and frame coils located on the magnetic circuit forming a screen with respect to the shield 11 in such a way that the force lines of the magnetic fields are not short-circuited by the shield. The front leading-out wires 17, 18 have been made with their diameter reduced to the minimum so as to reduce the effect of the shield on the magnetic fields generated. The rear leading-out wires 19, 20 are wound flat then covered with a ferrite ring 21 so that the force lines of the magnetic fields created by them loop back in the ring and are not short-circuited by the shield. The ferrite ring 22 complements the closing of the circuit for the force lines of the magnetic fields. Furthermore, the quadrupole coil 23 borne by this ring can be used to correct the convergence error along the 6H/12H axis which is proper to saddle-saddle type of magnetic deflectors and which has been referred to in the introduction.

This correction is obtained as follows.

The magnetic deflector according to the invention is set in the following way. In the first operation, the center of purity of the tube is made to coincide with the center of purity of the magnetic deflector by shifting the deflector along the axis of the tube. This operation is done according to the rules habitually employed in this respect, namely with the tube illuminated green. When this coincidence is obtained, the collar 36 is clamped so as to fix the deflector to the neck. In the second setting operation, the horizontal and vertical axes of the tube are made to coincide with the corresponding electromagnetic axes of the deflector by means of screws 33, with the associated nuts being screwed in to a greater or smaller extent. This operation is called yaming.

In the third operation a zero trilemma T is obtained. It will be noted that this trilemma is obtained in two stages: firstly, the 3H/9H convergence error and the horizontal red-blue trapezoid error Trh is cancelled, and then the 6H/12H convergence error is cancelled. The cancellation of C 3/9 and Trh is obtained by construction, by modifying the component of the first even harmonic H2 of the magnetic field of the deflector in the line coil for the convergence 3H/9H and the frame coil for the trapezoid Trh. The cancellation of the convergence error 6H/12H is obtained, as indicated above, by setting the value of the parabola-shaped current which flows through the quadrupole coil 23 of the ferrite ring 22.

There is another correction to be made, which has not been referred to until now. In principle, the convergence correction introduces a cushion-shaped magnetic field for the line and a barrel-shaped magnetic field for the frame. Hence, inside the deflector, the electron beams are not subjected to one and the same uniform magnetic field. The result of this is that the green beam undergoes a deflection different from that of the red and blue beams; a fault of this type, known as the coma error, has the result of making a green picture appear on the screen, the amplitude of the said green picture being smaller than that of the magenta picture which results from the superimposition of the red and blue images.

In trichromatic tubes of the prior art, this correction is usually obtained by magnetic parts set on either side of the red and blue beams in such a way as to short-circuit the force lines of the magnetic field in varying degrees, and this diminishes the effect of the magnetic field on each of the red and blue beams in varying degrees.

This way of conducting the operation is not possible for a high scanning frequency used in a high-definition trichromatic tube, for the high-frequency magnetic field created by the line coil would heat the magnetic parts, thus modifying their characteristics and, hence, modifying the setting of the coma error cancellation.

According to the present invention, the coma error is cancelled by modulating the amplitude of the magnetic field in the rear of the deflector at the ferrite ring 21. This magnetic field modulation is obtained through a suitable distribution of the line and frame coil sections along the axis of the tube and angularly.

More precisely, as can be seen in the diagram of FIG. 6, which is a flat or evolute view, at the rear ends, of the interior of half a coil, the sections 45 and 46 are separated from the sections 47, 48 and 49 by a distance h in the longitudinal direction and by a distance m which has the shape of a circular arc. In the longitudinal direction, the various sections are set in notches which delimit the separations such as those marked 50 and 51 between the sections 47, 48 and 49. This special arrangement of the sections can be used to modify the distribution of the magnetic field along the length of the ferrite ring.

What is claimed is:

1. A magnetic deflector of the saddle-saddle type for trichromatic tubes with external shielding including three in-line guns and containing round luminophors as well as a high definition screen, herein said tube is planned for operation with a saddle-torus type of deflector, said saddle-type magnetic deflector comprising:

a horizontal deviation coil of the saddle-type surrounding the tube at the flared portion of the tube near the neck wherein said coil has front lead-out wires of reduced dimensions as well as rear lead-out wires laid flat and parallel with the axis of said tube;

a vertical deviation coil of the saddle-type surrounding said horizontal deviation coil wherein said vertical deviation coil has front lead-out wires of reduced dimensions as well as rear lead-out wires laid flat and parallel with the longitudinal axis of said tube;

a flare-shaped sleeve made of ferromagnetic material surrounding said vertical deviation coil, wherein said flare-shaped sleeve having a rear section terminating in a circular-sectioned cylinder which entirely covers said rear lead-out wires of both said vertical and horizontal deviation coils;

a ferrite ring set around said neck in the immediate vicinity of the rear portion of said sleeve and in the immediate vicinity of the horizontal and vertical deviation coils wherein said ring has at least one quadrupole coil; and means for causing a current to flow in said at least one quadrupole coil of said ferrite ring wherein the intensity of said current varies parabolically.

2. A magnetic deflector according to claim 1 wherein said rear lead-out wires of said horizontal and vertical deviation coils have a plurality of sections spaced from each other longitudinally and radially for cancelling the coma error.

3. A magnetic deflector according to claim I wherein said circular-sectioned cylinder which terminates said sleeve is made of a theromagnetic material which is a second ferrite ring.

4. A magnetic deflector according to claim 1 further comprising two flare-shaped non-magnetic sleeves which nest into said ferromagnetic sleeve and wherein said two flare-shaped sleeves have notches made on there inside surfaces and wherein said horizontal and vertical deviation coil sections are set in said notches.

5. A magnetic deflector according to claim 1 wherein said current causing means comprises an integrated circuit which is input with a portion of the current flowing in said vertical deviation coil and an amplifier circuit driving said quadrupole coil.

6. A magnetic deflector according to claim 1 wherein said ferrite ring is sheathed in a sealing made of non-magnetic material and wherein the front side of said sealing works together with the rear side of said ferromagnetic sleeve in order to provide for horizontal and vertical shifting of said ferromagnetic sleeve and of said coils associated therewith to thereby provide coincidence between the horizontal and vertical deflection axis of the tube and the corresponding axis of the horizontal and vertical deviation coils.

7. A magnetic deflector according to claim 5 wherein said rear side of said ferromagnetic sleeve has a spherical shape and wherein the front of said sealing has a circular shoulder on which the rear of said spherical shape can slide and wherein the circular shoulder and the rear side of the sleeve are held in contact and shifted with respect to each other by a system of screws.

8. A method for setting a magnetic deflector of the saddle-saddle type for trichromatic tubes with external shielding, including three in-line guns and containing round luminophors as well as a high definition screen, wherein said tube is planned for operation with a saddle-torus type of deflector, said saddle-type magnetic deflector comprising:

a horizontal deviation coil of the saddle-type surrounding the tube at the flared portion of the tube near the neck wherein said coil has front lead-out wires of reduce dimensions as well as rear lead-out wires laid flat and parallel with the axis of said tube;

a vertical deviation coil of the saddle-type surrounding said horizontal deviation coil wherein said vertical deviation coil has front lead-out wires of reduced dimensions as well as rear lead-out wires laid flat and parallel with the longitudinal axis of said tube;

a flare-shaped sleeve made of ferromagnetic material surrounding said vertical deviation coil, wherein said flare-shaped sleeve having a rear section terminating in a circular-sectioned cylinder which entirely covers said rear lead-out wires of both said vertical and horizontal deviation coils;

a ferrite ring set around said neck in the immediate vicinity of the rear portion of said sleeve and in the immediate vicinity of the horizontal and vertical deviation coils wherein said ring has at least one quadrupole coil; and means for causing a current to flow in said at least one quadrupole coil of said ferrite ring wherein the intensity of said current varies parabolically, said method comprising the following steps:

positioning said deflector on the flared part of the tube so that the center of purity of the tube is made to coincide with the center of purity of the deflector;

shifting each of said coils and said ferromagnetic sleeve with respect to said ferrite ring in order to provide coincidence between the horizontal and vertical axis of the tube and the corresponding electromagnetic axis of the deflector; and setting the value of the current flowing through said quadrupole coil of the ferrite ring so as to cancel the convergence error 6H/12H, with the convergent error 3H/9H and the horizontal trapezoid error being cancelled by means of said coils being constructed so as to modify the component of the first even harmonic H2 of the magnetic filed created by said coils.

* * * * *